US007651348B2

(12) United States Patent
Huang et al.

(10) Patent No.: US 7,651,348 B2
(45) Date of Patent: Jan. 26, 2010

(54) ELECTRIC SOCKET HAVING AUTOMATIC APERTURE SHUTTER

(76) Inventors: Fu-Hsiang Huang, No. 11, Ging Zai Lane, Sec. 3, Zhongshan Rd., Wuri Shiang, Taichung County 414 (TW); Chang-Chin Yang, No. 33, Tongping Lane, Beitun District, Taichung City 406 (TW)

( * ) Notice: Subject to any disclaimer, the term of this patent is extended or adjusted under 35 U.S.C. 154(b) by 0 days.

(21) Appl. No.: 12/181,523

(22) Filed: Jul. 29, 2008

(65) Prior Publication Data

US 2009/0325410 A1 Dec. 31, 2009

(30) Foreign Application Priority Data

Jun. 27, 2008 (TW) ..... 97124349 A

(51) Int. Cl.
*H01R 13/44* (2006.01)

(52) U.S. Cl. ..... 439/137

(58) Field of Classification Search ..... 439/137, 439/145

See application file for complete search history.

(56) References Cited

U.S. PATENT DOCUMENTS 5,069,630 A * 12/1991 Tseng et al. ..... 439/137
6,786,745 B1 * 9/2004 Huang ..... 439/137

* cited by examiner

*Primary Examiner*—Ross N Gushi
(74) *Attorney, Agent, or Firm*—Browdy & Neimark, PLLC

(57) ABSTRACT

An electric socket includes a casing having two apertures and a shutter member, which has two bores, provided under the casing. The shutter member may be moved between a first position, in which the shutter member closes the apertures of the casing, and a second position, in which the bores of the shutter member are aligned with the apertures of the casing by a driving device. The shutter member is moved downward when a plug is inserted, and the shutter member will be moved to the second position at the same time. When the plug is pulled out, two biasing members will urge the shutter member upward, and a return device will return the shutter member back to the first position that the shutter member will close the apertures automatically when the plug is pulled out.

8 Claims, 6 Drawing Sheets

ELECTRIC SOCKET HAVING AUTOMATIC APERTURE SHUTTER

BACKGROUND OF THE INVENTION

1. Field of the Invention

The present invention relates to an electric socket and more particularly, to an electric socket having an automatic aperture shutter for safety.

2. Description of the Related Art

The operation of plug and socket is very common in everyday. Typically, a conventional socket has an insulating casing having two or three apertures thereon and electrodes in the casing behind the apertures. The plug has two or three prongs to be inserted into the apertures of the socket and electrically contact the electrodes.

There always are some children inserting wires into the socket to get electric shock accidents at home. To prevent electric shock accident, socket shields are the most common device that the parents use. Such socket shield is made of an insulating material, such as plastic, having a lid and two prongs on a back of the lid. Same as the plug, user may insert the prongs of the sock shield into the apertures of the socket to prevent children touching the socket. When the socket is needed, user may hold a ring on the lid and pull the socket shield out. It always happens that people forgets to put the socket shield back when he/she pulls the plug out, or the socket shield is missing that would make the socket exposing. Besides, the socket shield is not functional for elder children because they might learn how to remove the socket shield

SUMMARY OF THE INVENTION

The primary objective of the present invention is to provide an electric socket, which may prevent children inserting an improper stuff into the socket.

To achieve the objective of the present invention, an electric socket includes a casing having two apertures and a shutter member, which has two bores, provided under the casing. The shutter member may be moved between a first position, in which the shutter member closes the apertures of the casing, and a second position, in which the bores of the shutter member are aligned with the apertures of the casing. The shutter member is further moved between a third position, in which the shutter member is proximal to the casing, and a fourth position, in which the shutter member is distal to the casing. A driving device is provided to move the shutter member to the second position from the first position when the shutter member is moved to the fourth position from the third position that a plug may be inserted into the electric socket, and a return device is provided to move the shutter member back to the first position from the second position when the shutter member is moved to the third position from the fourth position that the shutter member will close the apertures automatically when the plug is pulled out.

means for driving when the shutter member is moved to the fourth position from the third position; and means for returning

DETAILED DESCRIPTION OF THE INVENTION

Figure 1:
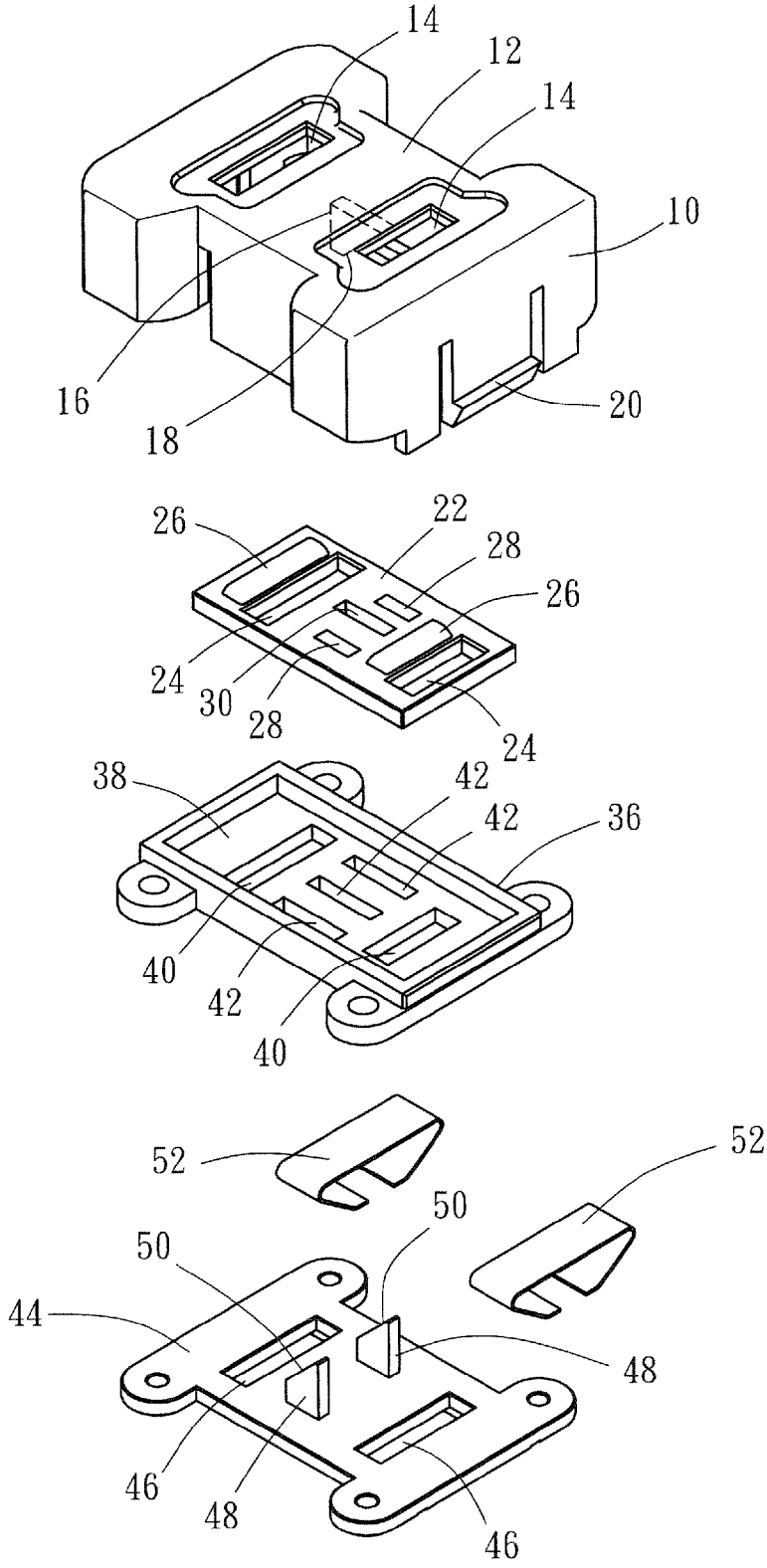
FIG. 1 is an exploded view of a preferred embodiment of the present invention.
Figure 2:
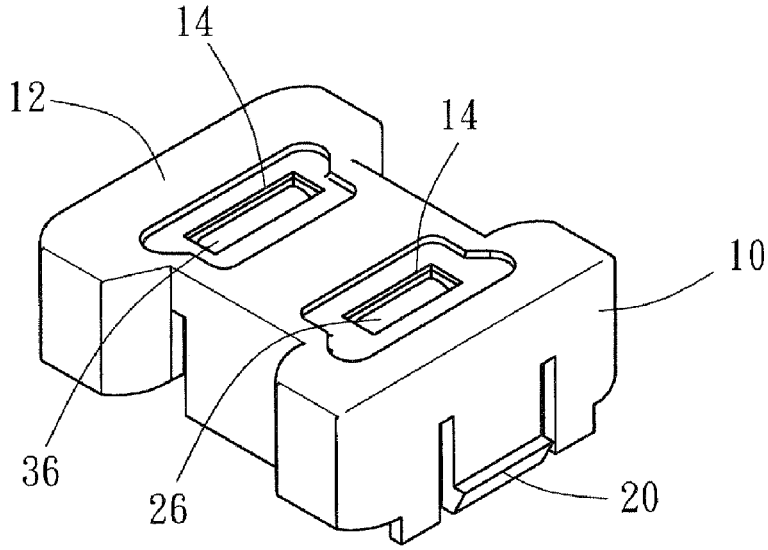
FIG. 2 is a perspective view of the preferred embodiment of the present invention.
Figure 3:
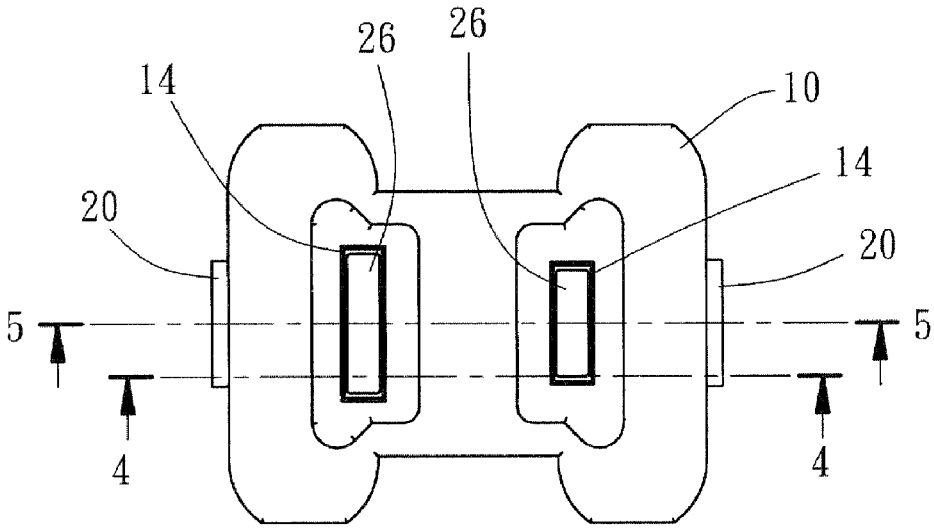
FIG. 3 is a top view of the preferred embodiment of the present invention.

FIGS. 1~3 show an electric socket of the preferred embodiment of the present invention, which includes a casing, a shutter member 22, a base member 36, a bottom base 44, and two biasing members 52.

The casing 10 has a top 12, on which two apertures 14 are provided, a return device 16 projected from a back side of the top 12. The return device 16 is a triangular plate having a return sloping face 18 on a distal end thereof. The casing 10 further has two hooks 20 on opposite sides to secure the casing 10 on an object, such as a wall.

The shutter member 22 has two bores 24 and two protrusions 26. Each of the protrusions 26 are beside the bores 24 respectively, for example, on the left sides of the bore 24 as shown in FIG. 1. On a center of the shutter member 22 has two first slots 28 and a second slot 30 between the first slots 28. Each of the first slots 28 has a driving sloping face 32 on a left end thereof, and the second slot 30 has a return sloping face 34 on a right end thereof.

The base member 36 has a recess portion 38 on a top thereof to receive the shutter member 22 therein and allow it moving right and left thereon. The base member has two bores 40 and three through holes 42 between the bores 40.

The bottom base 44 has two bores 46 and two driving devices 48 between the bores 46. Each of the driving devices 48 has a driving sloping face 50 on a distal end thereof.

Figure 4:
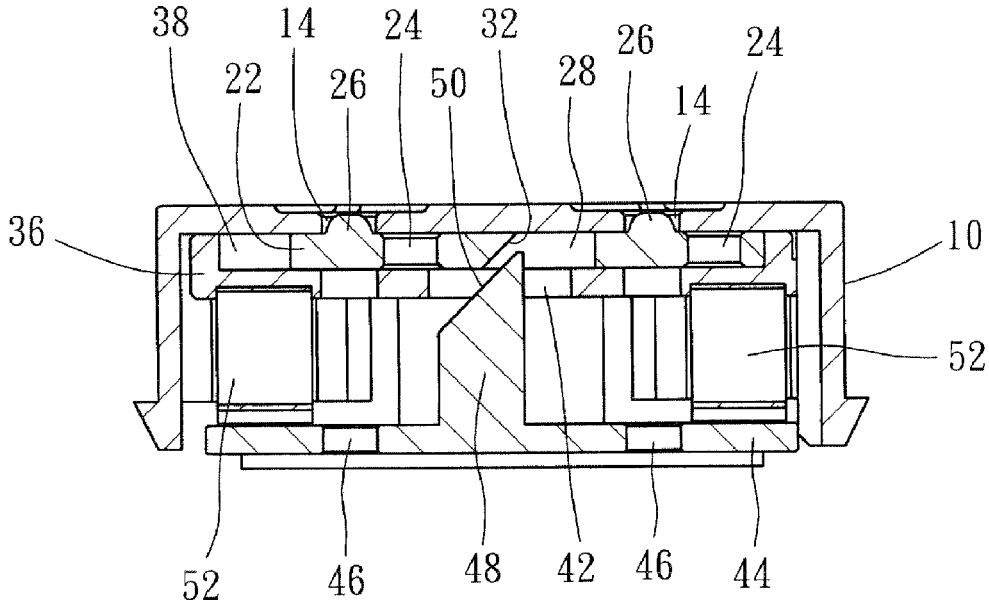
FIG. 4 is a sectional view along the 4-4 line of FIG. 3, showing the initial condition of the electric socket of the present invention.

As shown in FIG. 4, the shutter member 22 is provided under the top 12 of the casing 10 with the return device 16 inserted into the second slot 30 of the shutter member 22, therefore the return sloping face 18 of the return device 16 is associated with the return sloping face 34 of the shutter member 22. The base member 36 is under the shutter member 22 having the through holes 42 aligned with the first slots 28 and the second slot 30 of the shutter member 22 respectively and the bores 14 aligned with the apertures 14 of the casing 10. The bottom base 36 is under the base member 36 having the driving devices 48 entering the first slots 28 of the shutter member 22 via the through holes 42 of the base member 36, therefore the driving sloping faces 50 of the driving devices 48 are associated with the driving sloping faces 32 of the shutter member 22. The biasing members 52 are two U-shaped elastic plates and are provided between the base member 36 and the bottom base 44.

Figure 5:
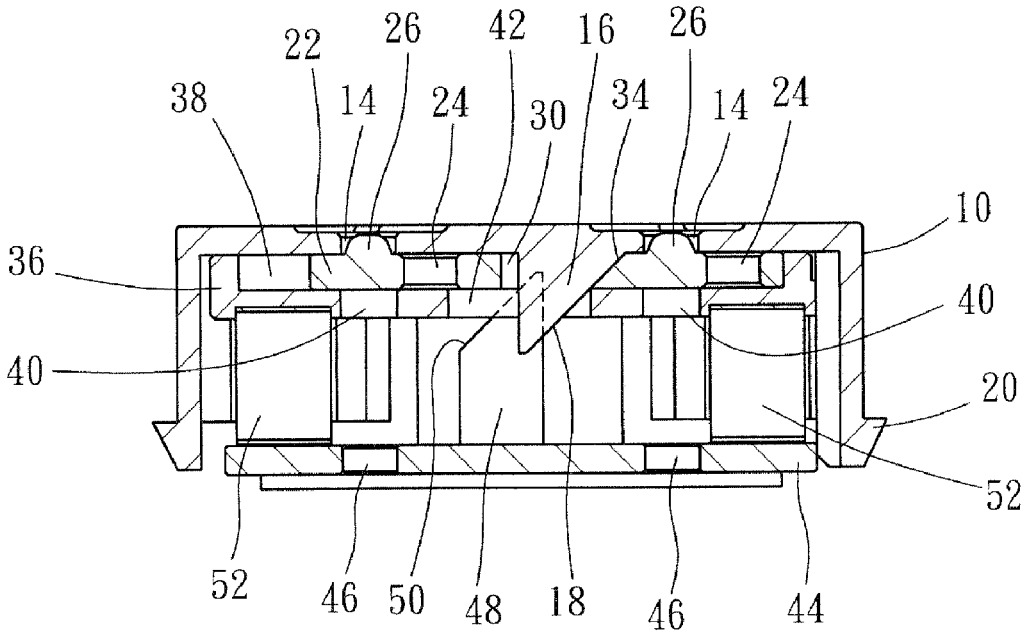
FIG. 5 is; a sectional view along the 5-5 line of FIG. 3

As shown in FIG. 4 and FIG. 5, at an initial condition of the electric socket of the embodiment of the present invention, the shutter member 22 is located at a first position, which is on the right of the recess portion 38 of the base member 36, and the shutter member 22 and the base member 36 are located at a third position, which is proximal to the top 12 of the casing 10. In the initial condition, the protrusions 26 of the shutter member 22 are in the apertures 14 of the casing 10 respectively, and the driving slopping faces 32 of the shutter member 22 are above the driving slopping faces 50 of the driving devices 48 and keep a predetermined distance therebetween that the apertures 14 are closed by the shutter member 22. The shutter member 22 will be moved only when both of the protrusions 26 are pressed at the same time. When only one protrusion 26 is pressed, it will cause an unbalance pressure on the shutter member 22 and the shutter member 22 will not move, so that children can't insert the wire or other improper members into the apertures 14 of the electric socket of the present invention.

Figure 6:
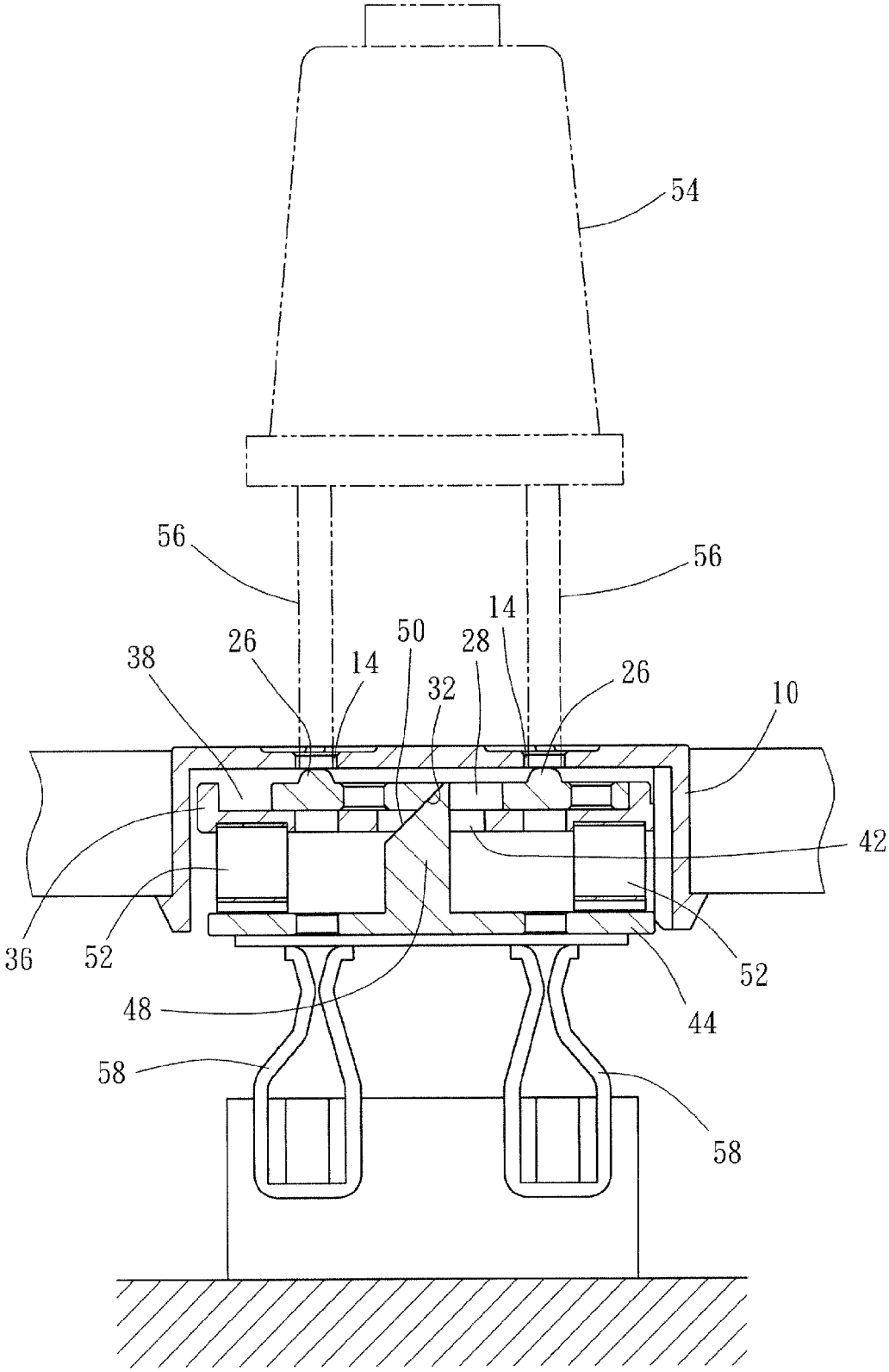
FIG. 6 is a sectional view of the preferred embodiment of the present invention, showing the plug being inserted in beginning.
Figure 7:
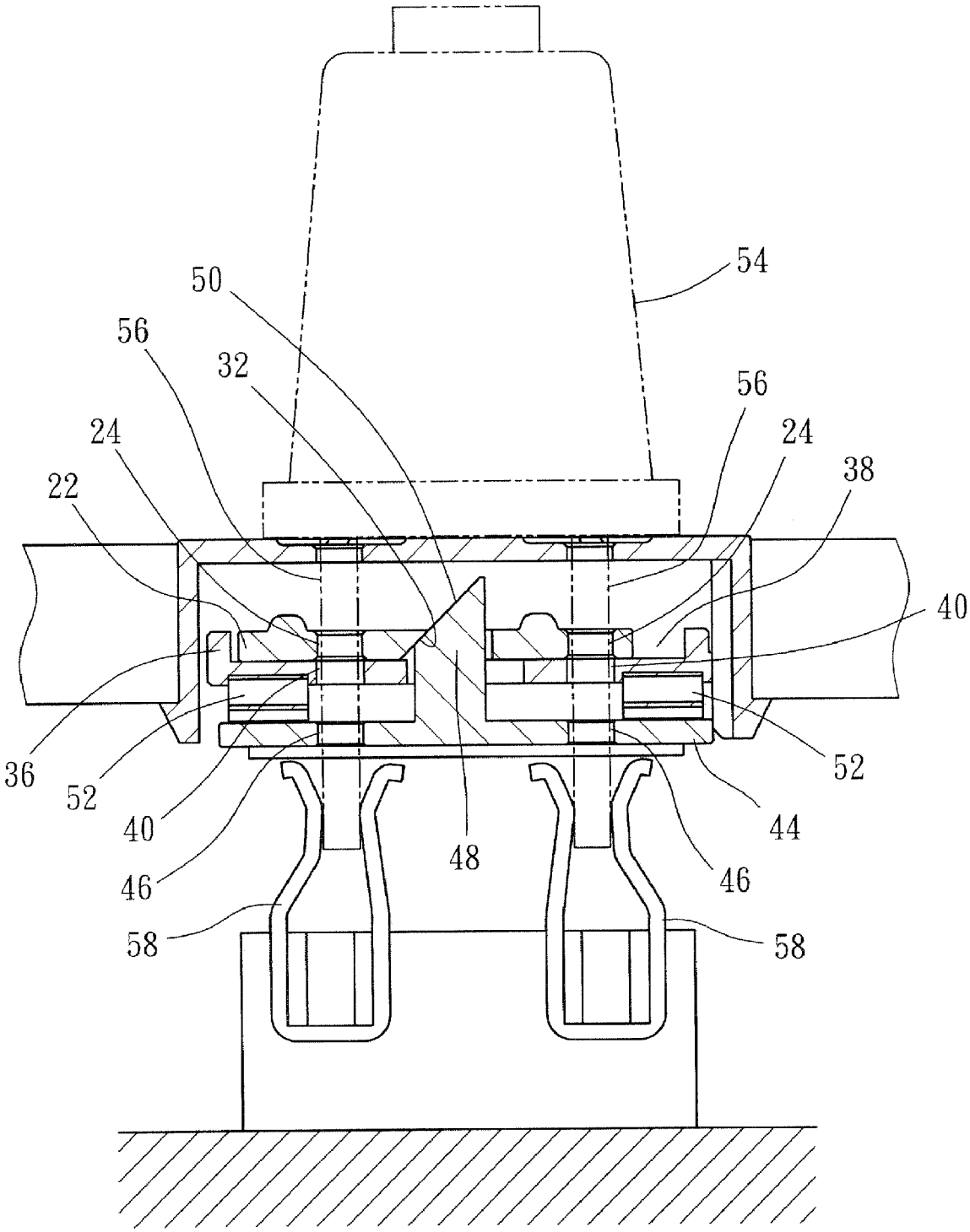
FIG. 7 is a sectional view following FIG. 6, showing the plug being inserted totally.

When a plug 54 is inserted into the electric socket of the present invention, two prongs 56 of the plug 54 enter the apertures 14 to press the protrusions 26 downward until the protrusions 26 leave the apertures 14, as shown in FIG. 6. At this time, the driving slopping faces 32 of the shutter member 22 will touch the driving slopping faces 50 of the driving devices 48. When the plug 54 is exerted continuously, the shutter member 22 and the base member 36 will be moved downward to a fourth position, and, in the same time, the shutter member 22 will be moved right relative to the base member 36 to a second position because of the action of the driving slopping faces 32 of the shutter member 22 and the driving slopping faces 50 of the driving devices 48, as shown in FIG. 7. In this condition, the bores 24 of the shutter member 22 will move to right under the apertures 14 of the casing 10 that the prongs 56 of the plug 54 may pass through the shutter member 22, the base member 36, and the bottom base 44 to contact two electrodes 58 under the bottom base 44 for an electric power conduction.

Figure 8:
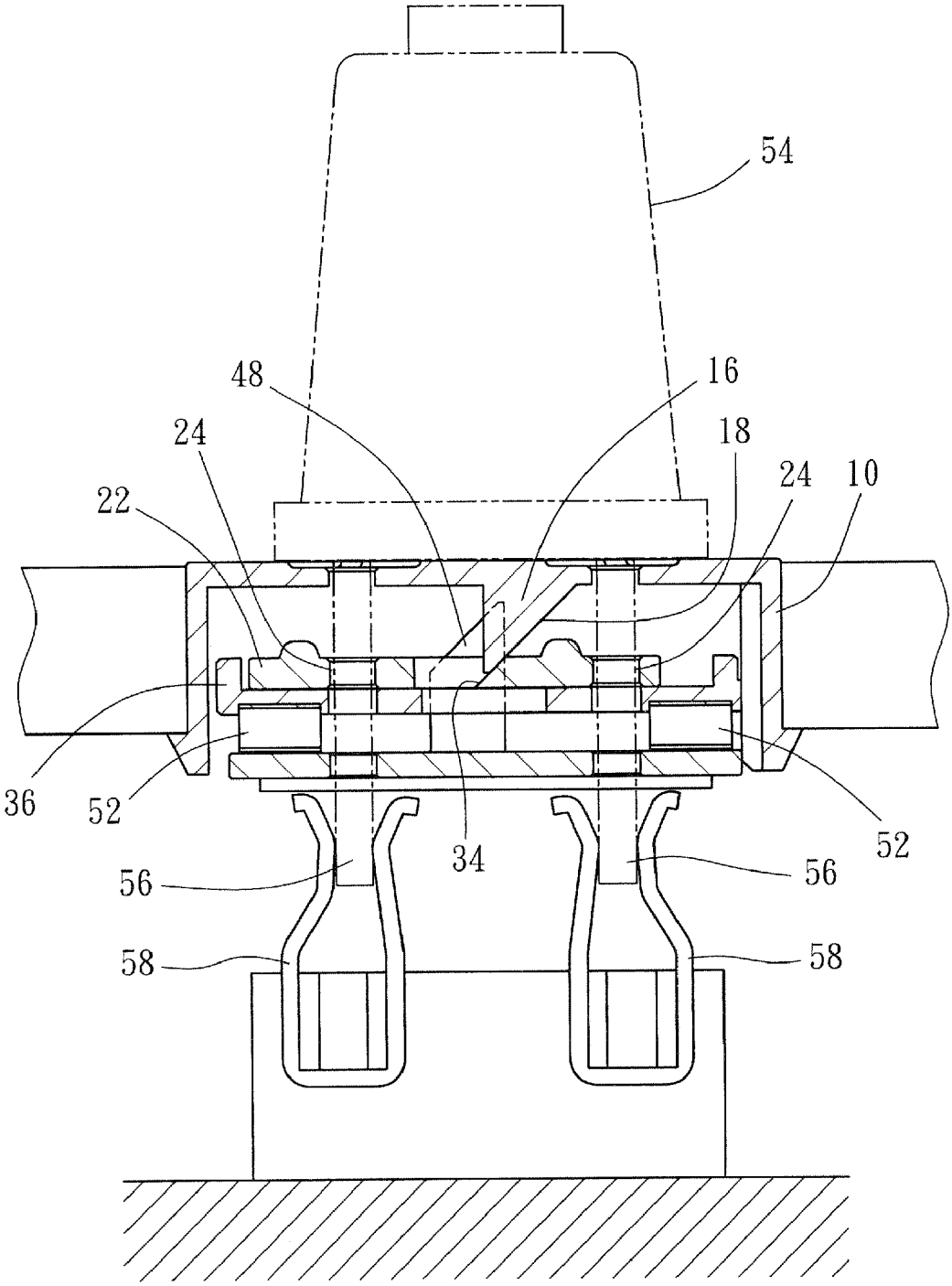
FIG. 8 is a sectional view of the preferred embodiment of the present invention, showing the action of the return device.

As shown in FIG. 8, the biasing members 52 are compressed when the plug 56 is inserted, but the shutter member 22 and the base member 36 will not be urged back to the first position by the biasing members 52 because of the prongs 56 passing through the bores 24 of the shutter member 22 and the return slopping face 18 of the return device 16 against the return slopping face 34 of the shutter member 22, therefore, the shutter member 22 and the base member 36 will be restricted at the fourth position, and the shutter member 22 will be restricted at the second position when the plug 54 is still inserted. When the plug 56 is pulled out, the biasing members 52 will urge the shutter member 22 and the base member 36 upward to the third position, and, in the same time, the shutter member 22 will be moved back to the first position because of the action of the return slopping face 18 of the return device 16 and the return slopping face 34 of the shutter member 22 that the electric socket return to the initial condition as shown in FIG. 4.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An electric socket, comprising:

a casing having two apertures;

a shutter member, which has two bores;

a base member, having a recess portion to receive a shutter member therein, wherein the recess portion allows the shutter member to be moved under the casing between a first horizontal position with respect to the base member, in which the shutter member closes the apertures of the casing, and a second horizontal position with respect to the base member, in which the bores of the shutter member are aligned with the apertures of the casing, wherein the recess portion also allows the base member to be moved together with the shutter member between a first vertical position with respect to the casing, in which the shutter member is proximal to the casing, and a second vertical position with respect to the casing, in which the shutter member is distal to the casing;

means for driving the shutter member to the second horizontal position from the first horizontal position when the shutter member is moved from the first vertical position to the second vertical position; and means for returning the shutter member back to the first horizontal position from the second horizontal position when the shutter member is moved from the second vertical position to the first vertical position.

2. The electric socket as claimed in claim 1, further comprising a biasing member to urge the shutter member from the second vertical position to the first vertical position.

3. The electric socket as claimed in claim 1, wherein the shutter member has two protrusions received in the apertures when the shutter member is moved to the first horizontal position and the first vertical position.

4. The electric socket as claimed in claim 3, wherein the driving means does not touch the shutter member when the protrusions of the shutter member are received in the apertures of the casing, and the driving means touches the shutter member when the protrusions of the shutter member leave the apertures of the casing.

5. An electric socket, comprising:

a casing having two apertures;

a shutter member, which has two bores, capable of moving under the casing between a first position, in which the shutter member closes the apertures of the casing, and a second position, in which the bores of the shutter member are aligned with the apertures of the casing;

means for driving the shutter member to the second position from the first position when the shutter member is moved from a position proximal to the casing to a position distal to the casing; and means for returning the shutter member back to the first position from the second position when the shutter member is moved from the position distal to the casing to the position proximal to the casing, wherein the driving means includes a driving device having a driving sloping face and a driving sloping face on the shutter member.

6. The electric socket as claimed in claim 5, wherein the shutter member has a first slot, on an end of which the driving sloping face is provided, and the driving device enters the first slot to have the driving slopping face thereof associated with the driving sloping face of the shutter member.

7. An electric socket, comprising:

a casing having two apertures;

a shutter member, which has two bores, capable of moving under the casing between a first position, in which the shutter member closes the apertures of the casing, and a second position, in which the bores of the shutter member are aligned with the apertures of the casing;

means for driving the shutter member to the second position from the first position when the shutter member is moved from a position proximal to the casing to a position distal to the casing; and means for returning the shutter member back to the first position from the second position when the shutter member is moved from the position distal to the casing to the position proximal to the casing, wherein the return means includes a return device having a driving sloping face and a driving sloping face on the shutter member.

8. The electric socket as claimed in claim 7, wherein the shutter member has a second slot, on an end of which the return sloping face is provided, and the return device enters the second slot to have the return slopping face thereof associated with the return sloping face of the shutter member.

* * * * *